US006211828B1

(12) United States Patent
Krylov et al.

(10) Patent No.: US 6,211,828 B1
(45) Date of Patent: Apr. 3, 2001

(54) RETRACTABLE ANTENNA UNIT FOR A MOBILE PHONE

(75) Inventors: Konatantine Stanislavovich Krylov, Suwon; Dong-Hwan Kim; Dong-In Ha, both of Seoul, all of (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/426,698

(22) Filed: Oct. 25, 1999

(30) Foreign Application Priority Data

Oct. 23, 1998 (KR) ..... 98-44500

(51) Int. Cl.[7] ..... H01Q 1/24; H01Q 1/36
(52) U.S. Cl. ..... 343/702; 343/895; 343/901
(58) Field of Search ..... 343/895, 702, 343/900, 901; H01Q 1/24, 1/36

(56) References Cited

U.S. PATENT DOCUMENTS 5,635,943 * 6/1997 Grunwell ..... 343/702
5,717,408 * 2/1998 Sullivan et al. ..... 343/702
5,764,191 * 6/1998 Tsuda ..... 343/702
5,812,097 * 9/1998 Maldonado ..... 343/702
5,859,617 * 1/1999 Fujikawa ..... 343/702
5,861,859 * 1/1999 Kanayama et al. ..... 343/702
6,002,372 * 12/1999 Sullivan ..... 343/702

* cited by examiner

*Primary Examiner*—Don Wong
*Assistant Examiner*—Hoang Nguyen
(74) *Attorney, Agent, or Firm*—Dilworth & Barrese, LLP

(57) ABSTRACT

A retractable antenna unit for a mobile phone including an antenna housing provided in the casing of the mobile phone, a helical antenna installed in the antenna housing, a whip antenna having an upper end provided with a knob and a lower end provided with a stopper, the stopper being also provided with a feeder part, and a metal tube for supplementing the length of the helical antenna when the whip antenna is completely retracted into the antenna housing, or serving to extend the operational length of the whip antenna when the whip antenna is completely extended from the antenna housing, whereby the wave feed position of the whip antenna is raised when the whip antenna is completely extended from the antenna housing.

9 Claims, 4 Drawing Sheets

RETRACTABLE ANTENNA UNIT FOR A MOBILE PHONE

BACKGROUND OF THE INVENTION

1. Field of the Invention

The present invention relates to a compact mobile phone, and more particularly a retractable antenna unit provided in a mobile phone operating in a low frequency band.

2. Description of the related art

A mobile phone, such as a cellular phone, is typically provided with a whip or helical antenna, whose length is $\lambda/4$ or $3\lambda/4$, where $\lambda$ is the wavelength of the received signal in accordance with the operating frequency. If a whip antenna is used, it must be in a extended position to maximize efficiency during calls, making it less compact and therefore, inconvenient for the user to carry. On the other hand, a helical antenna has a short physical length, and hence does not bring about such inconvenience. However, the efficiency of a helical antenna is low when compared to that of a whip antenna, due to its short physical height. Therefore, due to the helical antenna's degraded performance when compared to the whip antenna, it is desirable to have an antenna with a relatively longer physical height, such as the whip antenna.

In this view, a retractable antenna has been developed which combines a whip and helical antenna to realize the advantages of both types of antenna. Such an antenna is well disclosed in U.S. Pat. No. 5,479,178. Referring to this patent, when a mobile phone stands by to receive a call, the whip antenna may be retracted into the casing of the mobile phone, utilizing only the helical antenna for receiving incoming calls. When communication is established, the whip antenna may be completely extended from the casing to improve communication quality for the duration of the call.

However, such a retractable antenna would only be sufficient for the end if the body of the mobile phone is long enough to fully receive the retracted length of the whip antenna. Moreover, there is a trend toward making mobile phones more compact, especially with the current state of development of VLSI (very large system integration) technology, making space in a mobile phone's casing a premium. Further, when retracting the whip antenna into the casing, it must be decoupled from the wave feeding point. However, if the space for retracting the whip antenna into the casing is lacking, it becomes impractical to achieve complete decoupling.

Consequently, space is one of the key factors limiting the design of an antenna. Therefore, a need exists for a retractable antenna unit combining a whip antenna with a helical antenna, wherein the whip antenna of length $\lambda/3$ or $3\lambda/4$ can be completely retracted into a compact mobile phone while the helical antenna remains projected outside of the casing.

SUMMARY OF THE INVENTION

It is therefore an object of the present invention to provide a retractable antenna unit for a compact mobile phone, having a metal tube contacted with and supplementing the length of the helical antenna, the metal tube also supplementing the length of the whip antenna while extended.

It is another object of the present invention to provide a retractable antenna unit with a metal tube to increase space for housing the whip antenna in a retracted position and achieve complete decoupling of the whip antenna, for a mobile phone operated in a low frequency band.

According to an embodiment of the present invention, a retractable antenna unit for a mobile phone includes an antenna housing, a helical antenna installed in the antenna housing, a whip antenna having an upper end provided with a knob and a lower end provided with a stopper, the stopper being also provided with a feeder part, and a metal tube for supplementing the length of the helical antenna when the whip antenna is completely retracted into the antenna housing, or serving to extend the physically effective length of the whip antenna when the whip antenna is completely extended from the antenna housing, whereby the wave feed position of the whip antenna is raised when the whip antenna is completely pulled out from the antenna housing.

BRIEF DESCRIPTION OF THE ATTACHED DRAWINGS

The above and other objects, features, and advantages of the present invention will become more apparent in light of the following detailed description of an exemplary embodiment thereof taken in conjunction with attached drawings in which.

DETAILED DESCRIPTION OF THE PREFERRED EMBODIMENT

Figure 1:
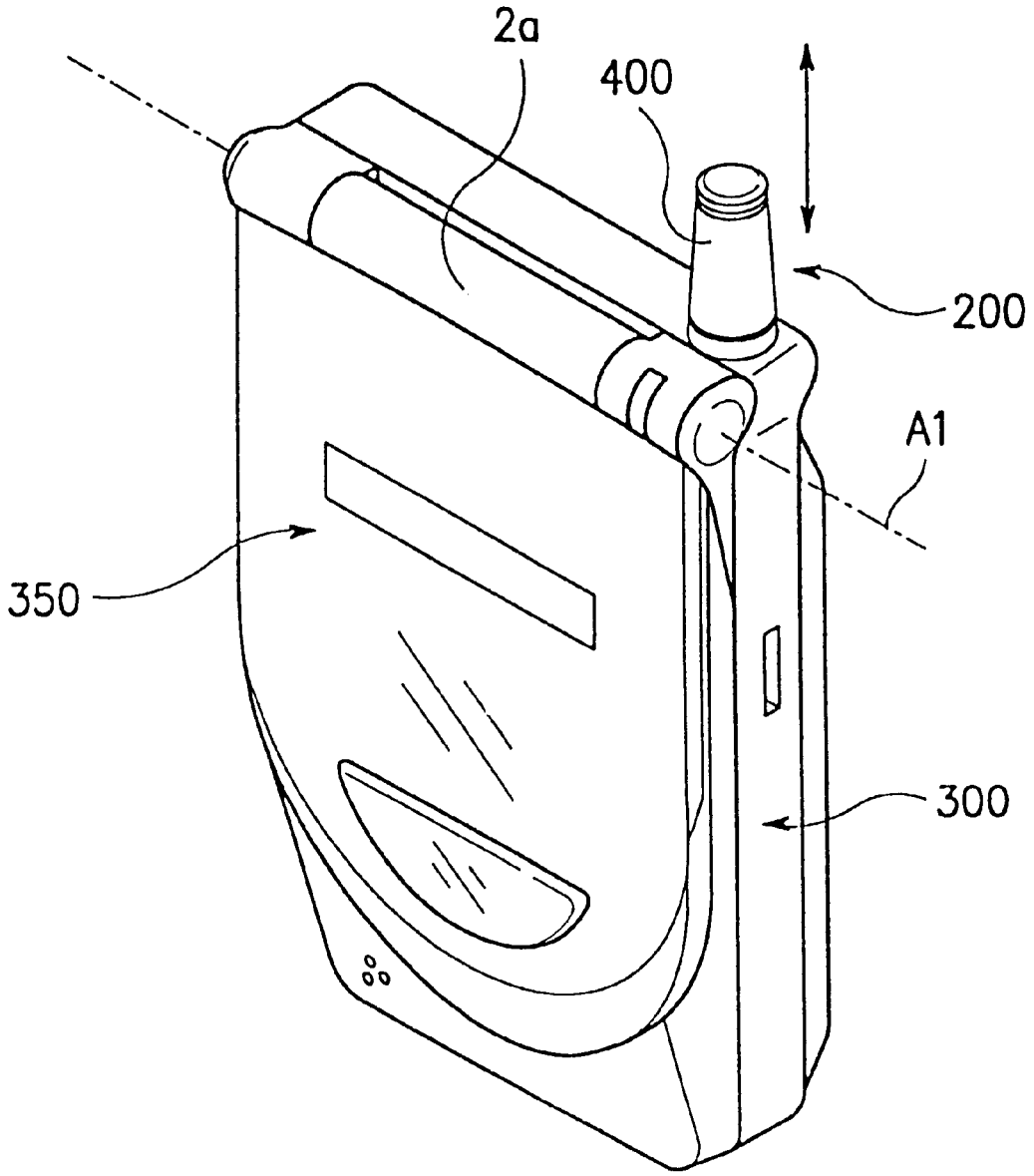
FIG. 1 is a perspective view for illustrating a flip type mobile phone provided with the antenna unit of the present invention.

Turning now to the drawings, in which like reference numerals identify similar or identified elements throughout the several views, and the detailed descriptions of elements not directly relating to the invention are omitted for clarity.

FIG. 1 shows a flip-type mobile phone, wherein the antenna unit of the invention is incorporated. Note however, the antenna of the present invention can be used with other types of mobile phones. The casing of the flip-type mobile phone comprises a body 300, flip 350, and hinge mechanism 2*a* for connecting the flip to the body. The flip 350 may be opened away or closed toward the body 300, pivoting about the central axis A1 of the hinge mechanism 2*a*. Mounted on the top right side of the body 300 is an antenna unit 200, beneath which the keypad (not shown) is located. The microphone 312 is mounted below the key pad and an car piece (not shown) is mounted on the upper part of the folder 350, including a speaker. The LCD (not shown) is provided below the ear piece. The LCD displays the operational information including the data input through the key pad.

The antenna of the present invention will now be described with reference to FIGS. 2 and 3. A metal tube 30 is employed to supplement the overall physical length of the whip antenna, which is limited by the compact height of the mobile phone. The metal tube 30 serves to extend both the operational length of the helical part 101 of the helical antenna 10, when the whip antenna 20 is retracted into the casing (body) of the mobile phone, and the operational length of the whip antenna 10, when the whip antenna 20 is fully extended from the casing of the mobile phone. Namely, the helical antenna 10 comprises the helical part 101 and the metal tube 30, and the metal tube 30 also serves to supplement the length of the whip antenna 20 when the whip antenna 20 is completely extended from the casing. Hence, by adjusting the lengths of the helical part 101 and metal tube 30, the overall storage space in the mobile phone will increase to accommodate the desired length whip antenna 30, making the addition of metal tube 30 advantageous for a compact size mobile phone operated in a low frequency band.

The added space provided by the metal tube 30 allows the whip antenna to completely retract into the casing of a compact mobile phone, making it possible to store an antenna of length 0.25 λ, for instance, even in a low frequency band CDMA (Code Division Multiple Access) and GSM (Global System for Mobile Communication) system. The problems of the prior art are overcome by substituting the metal tube 30 for a potion of the helical antenna, so that the helical antenna 10 and whip antenna 20 each have an overall length of 0.25 λ, for instance, while providing enough storage space for retracting a whip antenna of sufficient length to maximize efficiency.

Figure 2:
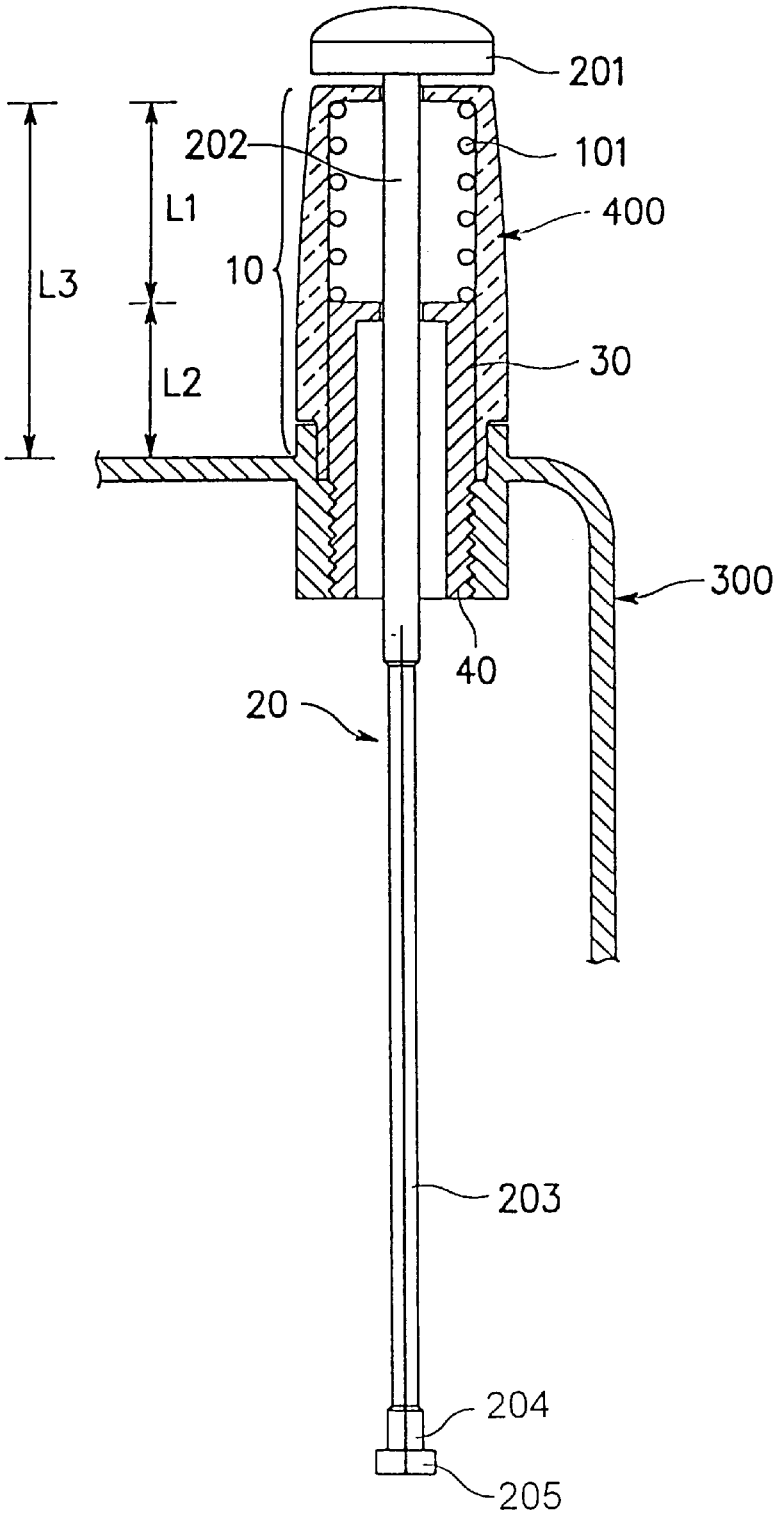
FIG. 2 is a partial cross sectional view of the antenna housing portion of a mobile phone illustrating the whip antenna of the present invention retracted into the casing of the mobile phone.

Referring to FIG. 2, when the whip antenna 20 is completely retracted into the casing, the helical antenna 10, comprising the helical part 101 and metal tube 30 serves as the effective antenna. The metal tube 30 is integrally formed with a threaded antenna fitting 40 and inserted into an antenna housing 400, which is mounted on the body 300 of the mobile phone by means of the antenna fitting 40. The knob rod 202 of the whip antenna must be insulated to a length sufficient to prevent coupling between the antenna fitting 40 and helical part 101, since, when completely retracted, the knob rod 202 is positioned throughout the helical part 101, metal tube 30 and antenna fitting 40.

Referring to FIG. 2, reference symbol L1 represents the physical operational length of the helical part 101, and L2 the length of the metal tube 30 projected from the casing, so that the total operational length L3 of the helical antenna 10 is L1+L2, while the whip antenna 20 is completely retracted into the casing.

Figure 3:
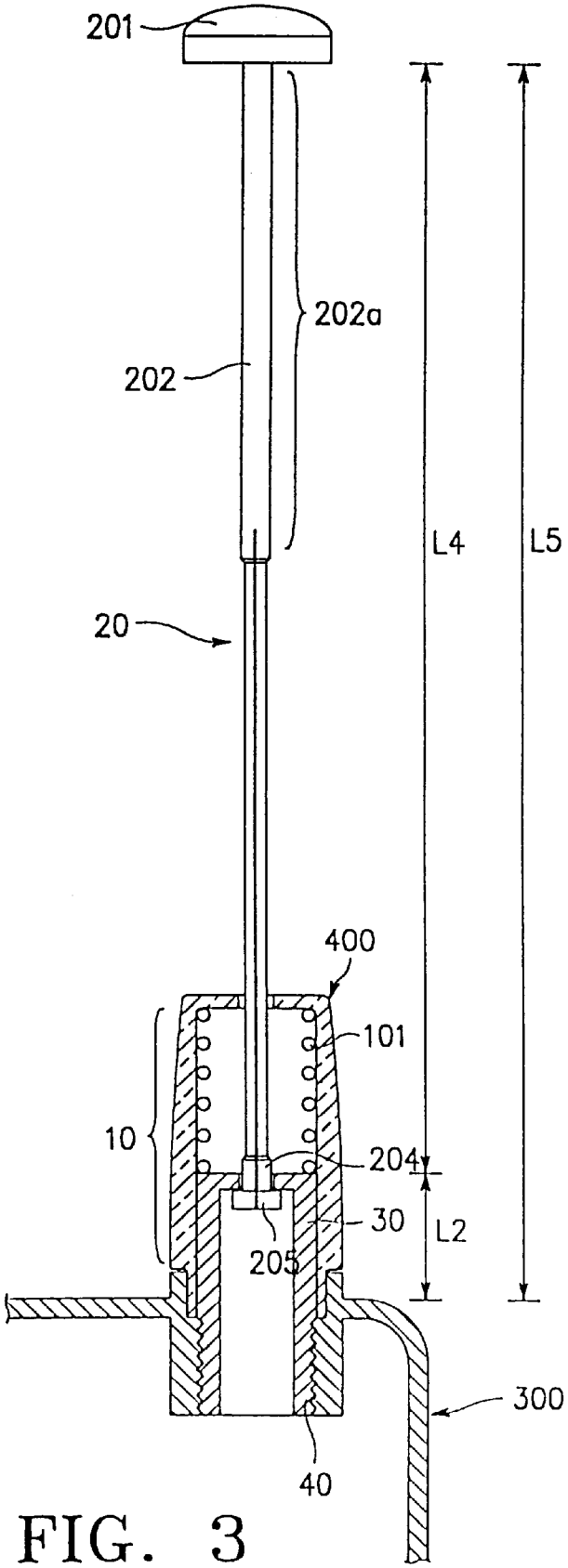
FIG. 3 is a partial cross sectional view illustrating the whip antenna of the present invention completely extended from the casing.

Referring to FIG. 3, when fully extended from the casing, the whip antenna 20 has the stopper 205 contacting the upper end of the metal tube 30, so that its operational length is supplemented by the length L2 of the metal tube 30. L2 represents the length of the metal tube projected from the casing, and L4 the length of the extended whip antenna 20, so that the total operational length L5 of the whip antenna 20 is L2+L4. Accordingly while, completely extended from the casing, the whip antenna 20 has an effective length of L5. Thus, the metal tube 30 is commonly used by both the helical antenna 10 and whip antenna 20.

Figure 4:
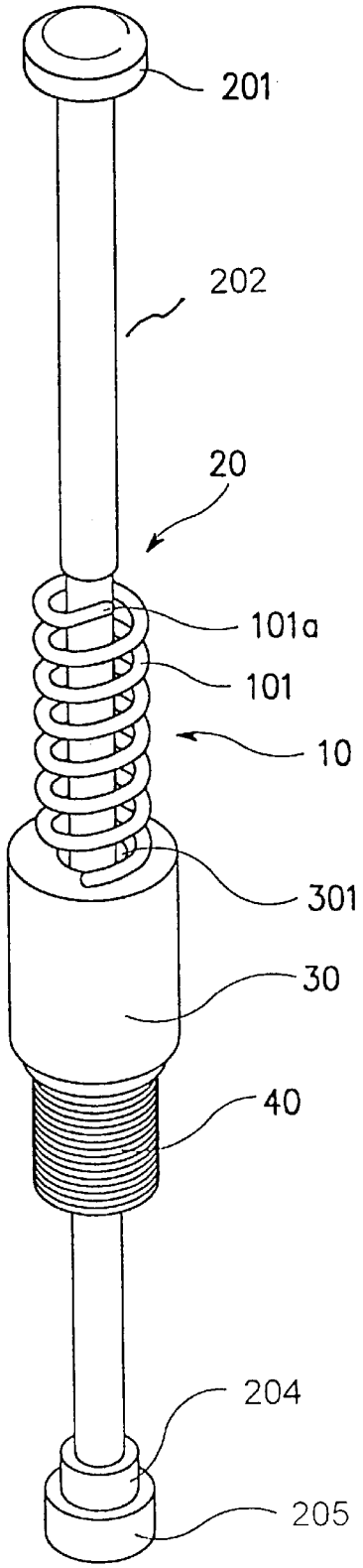
FIG. 4 is a perspective view for illustrating the retractable antenna unit provided with a metal tube according to the present invention.

FIG. 4 illustrate s the structure of the antenna unit in more detail. The whip antenna 20 is designed to be retracted into or extended from the casing while the helical antenna 10 is fixedly installed in the antenna housing 400. The whip antenna 20 has an antenna knob 201 at the upper end, and a stopper 205 at the lower end. The stopper 205 is provided with a first wave feeding a metal part 204. The metal tube 30 and antenna fitting 40 serve as a second wave feeding metal part corresponding to the first wave feeding metal part 204. The upper end 301 of the metal tube 30 is partially opened while the lower end fully opened (not shown). The whip antenna 20 may be retracted or extended through the cylindrical space of the second wave feeding metal. When the whip antenna is fully extended from the casing, the first wave feeding metal part 204 contacts the upper end 301 of the metal tube 30. On the contrary, while the whip antenna is fully retracted into the casing, the knob rod 202 of the whip antenna 20 is positioned throughout the inside of the helical antenna 10 and the second wave feeding metal part, namely, the metal tube 30 and antenna fitting 40. Additionally, the upper end 101*a* of the helical part 101 may be bent to reduce the space between the surface of the whip antenna 20 and the helical part 101, and thereby improving the coupling action between the whip antenna 20 and the helical part 101. Thus, the invention substitutes a metal tube for part of the helical antenna to supplement the physical length of the whip antenna for a compact mobile phone operated in a low frequency band.

While the present invention has been described in connection with specific embodiments accompanied by the attached drawings, it will be readily apparent to those skilled in the art that various changes and modifications may be made thereto without departing from the scope and spirit of the present invention as defined by the appended claims.

What is claimed is:

1. A retractable antenna unit for a mobile phone, comprising:

a helical antenna positioned in an upper portion of an antenna housing of the mobile phone;

a whip antenna having an upper end provided with a knob and a lower end provided with a stopper, said stopper being also provided with a first wave feeder part; and a metal tube having the whip antenna slidingly positioned therein, and forming a tubular antenna having a second wave feeder part in an upper portion thereof, the tubular antenna being positioned in a lower portion of the antenna housing and connected to said helical antenna for supplementing the operational length of said helical antenna when said whip antenna is completely retracted, or serving to extend the operational length of said whip antenna when said whip antenna is completely extended by contacting said first feeder part of said whip antenna to the second feeder part of the tubular antenna.

2. The retractable antenna recited in claim 1, further comprising an antenna housing for housing said helical antenna, said metal tube, and said whip antenna when said whip antenna is in a retracted position.

3. The retractable antenna recited in claim 1, wherein said metal tube has the lower end provided with a conductive threaded antenna fitting for fixing said metal tube into a mobile phone casing.

4. The retractable antenna as recited in claim 3, wherein said threaded antenna fitting is integrally formed with said metal tube.

5. The retractable antenna recited in claim 1, wherein said helical antenna has its lower end closely contacting the upper end of said metal tube.

6. The retractable antenna recited in claim 1, wherein the upper end of said helical antenna is bent inward so as to improve the coupling effect between said helical antenna and said whip antenna.

7. An antenna unit for a mobile phone comprising:

a first antenna having an upper end provided with a knob and a lower end provided with a stopper, said stopper also having a wave feeder part, the first antenna having an operable length defined by a distance between the knob and the stopper, the operable length including at least one insulated portion configured to prevent coupling in a retracted position, the first antenna being movable between the retracted position and an extended position;

a second antenna positioned in fixed spaced relation to the mobile phone to couple with the first antenna in the extended position, and the second antenna being positioned in apposition with the insulated portion of the first antenna in the retracted position; and a third antenna defining a longitudinal hole for the positioning of the first antenna and being configured to be connected with the first antenna in the extended position and configured to be connected with the second antenna when disconnected with the first antenna in the retracted position.

8. The antenna unit of claim 7, wherein the second antenna is a helical antenna.

9. The antenna unit of claim 7, wherein the third antenna is a tubular antenna.

* * * * *